United States Patent [19]

Yamagishi et al.

[11] 3,966,570

[45] June 29, 1976

[54] ELECTROLYTIC POST-TREATING METHOD OF ELECTROLYTICALLY CHROMATE TREATED OR METALLIC CHROMIUM PLATED STEEL SHEET

[75] Inventors: Hidehisa Yamagishi, Yokohama; Hiroshi Takano; Yoshitaka Kashiyama, both of Kawasaki, all of Japan

[73] Assignee: Nippon Kokan Kabushiki Kaisha, Tokyo, Japan

[22] Filed: June 18, 1974

[21] Appl. No.: 480,592

[30] Foreign Application Priority Data

Jan. 14, 1974 Japan ..... 49-6644

[52] U.S. Cl. ..... 204/140; 204/35 R; 204/35 N

[51] Int. Cl.[2] ..... C25D 5/48

[58] Field of Search ..... 204/56 R, 35 N, 140, 204/35 R

[56] References Cited

UNITED STATES PATENTS

| | | | |
|---|---|---|---|
| 2,755,242 | 7/1956 | Keller et al. | 204/140 |
| 3,247,086 | 4/1966 | Goldstein et al. | 204/140 |
| 3,642,587 | 2/1972 | Allen et al. | 204/35 N |

FOREIGN PATENTS OR APPLICATIONS

| | | | |
|---|---|---|---|
| 998,687 | 7/1965 | United Kingdom | 204/140 |

*Primary Examiner*—T. M. Tufariello
*Attorney, Agent, or Firm*—Flynn & Frishauf

[57] ABSTRACT

Method of electrolytically post-treating an electrolytically chromate treated or metallic chromium plated steel sheet comprises anodically treating the said electrolyticallv chromate threated or metallic chromium plated steel sheet in an electrolyte other than an aqueous solution easily dissolving metallic chromium. The anodically treated steel sheet can be treated cathodically in an electrolyte with the said anodically treated steel sheet being employed as the cathode.

6 Claims, No Drawings

ELECTROLYTIC POST-TREATING METHOD OF ELECTROLYTICALLY CHROMATE TREATED OR METALLIC CHROMIUM PLATED STEEL SHEET

BACKGROUND OF THE INVENTION

This invention relates to an electrolytic post-treating method of electrolytically chromate treated or metallic chromium plated steel sheet.

It is generally known that a film formed on the surface of an electrolytically chromate treated steel sheet comprises a metallic chromium layer and a hydrated chromium oxide layer, and no rust occurs on the said steel sheet surface under the effect of these two layers. There is a correlation between the said two layers formed on the surface of the said known electrolytically chromate treated steel sheet. An insufficient metallic chromium layer (one which is too thin) from among the said two layers results in the occurrence of many pores in the said metallic chromium layer. In order to maintain the level of corrosion resistance of the said steel sheet in this case, it is necessary to increase the thickness of the other hydrated chromium oxide layer. However, there is a limitation in the thickness of the said hydrated chromium oxide layer: a layer which is too thick impairs the surface quality of the said electrolytically chromate treated steel sheet with respect to deterioration of paint adhesion, formability and appearance.

With a view to avoiding these drawbacks, it has been proposed to reduce the thickness of the said hydrated chromium oxide layer and to increase that of the said metallic chromium layer. In this method, however, it is recognized that it it impossible to raise the production line speed and the formability worsens.

Some typical methods from among many methods conventionally available for the electrolytic chromate treatment of a steel sheet surface are described hereinafter.

Firstly, a generally known method is that disclosed in U.S. Pat. Nos. 3,337,431; 3,296,100 and 3,679,554, in which, in the plating process of a steel sheet, two layers comprising a metallic chromium layer and a hydrated chromium oxide layer of an appropriate thickness are deposited on the said steel sheet surface. In this method, however, it is difficult to control the amount of hydrated chromium oxide deposited on the steel sheet surface, and a close control of bath composition is required.

Another generally known method is one disclosed in French Pat. No. 7,125,682, comprising depositing a metallic chromium layer and a hydrated chromium oxide layer on a steel sheet surface in the plating process, and then chemically treating the thus deposited film bearing steel sheet surface. In this method, properties such as corrosion resistance, paint adhesion and adhesive property of the steel sheet surface are improved, whereas the said chemical treatment process not only impairs acceleration of the production line speed, but also exerts adverse effects on the surface exterior view of the sheet surface.

Further, as disclosed in British Pat. No. 1,187,785, a method comprising causing deposition of metallic chromium on a steel sheet surface in a plating process, and then forming a hydrated chromium oxide layer by a chemical conversion treatment of the said deposited surface, is known. It is very difficult, however, to impart satisfactory properties to the steel sheet surface by a simple cathodic electrolytic treatment in such a bath containing hexavalent chromium.

In addition, in the treating methods as mentioned above, it is impossible to fill with hydrated chromium oxide, pores and other defects present in the metallic chromium layer formed on the steel sheet surface, since the cathodic electrolytic treatment is applied in an electrolyte containing hexavalent chromium, and this makes it impossible to impart a satisfactory corrosion resistance to the steel sheet surface.

With these facts in view, there has been a desire to obtain a steel sheet having a bright appearance and a high corrosion resistance by making up pores and other defects present in the chromium plating layer of an electrolytic chromate treated steel sheet or a metallic chromium plated steel sheet. A steel sheet having such surface properties has not as yet been proposed.

SUMMARY OF THE INVENTION

One of the main objects of this invention is therefore to provide a method for electrolytically post-treating an electrolytically chromate treated or metallic chromium plated steel sheet, free from the defects mentioned above.

Particularly, one of the main objects of this invention is to provide an electrolytic post-treating method for eliminating defects present in the film of an electrolytically chromate treated or metallic chromium plated steel sheet.

Furthermore, another object of this invention is to provide an electrolytically treating method for the formation of a film having a bright appearance and a high corrosion resistance on the steel sheet surface.

Another object of this invention is to provide a post-treating method in which defects present in the film of an electrolytically chromate treated or metallic chromium plated steel sheet are reduced or eliminated by anodically treating the said steel sheet in an electrolyte, and if necessary, further cathodically treating it.

Another important object of this invention is to impart a bright appearance as well as a high corrosion resistance to an electrolytically chromate treated or metallic chromium plated steel sheet surface, by anodically treating the said steel sheet in an electrolyte, and if necessary, further cathodically treating it.

This invention is characterized by the following features: an electrolytic chromate treating layer or a metallic chromium plating layer is formed on a steel sheet surface by surface treating the said steel sheet; the said steel sheet having thus formed film is anodically treated in an electrolyte; and then, if necessary, the said anodically treated steel sheet is further cathodically treated in an electrolyte with the said steel sheet as the cathode.

DESCRIPTION OF PREFERRED EMBODIMENTS

In this invention, a remarkable improvement in the quality of electrolytically chromate treated or metallic chromium plated steel sheet is achieved by anodically treating the said steel sheet in an aqueous electrolyte, and then, if necessary, cathodically treating in an aqueous electrolyte with the said anodically treated steel sheet as the cathode.

The electrolytic post-treatment in this invention is carried out with the use of an aqueous solution which does not easily dissolve metallic chromium as the anodic electrolyte. In particular, the use of the same treating solution as that for the cathodic electrolysis applied as a post-treatment as described later in this specification, permits anodic/cathodic treatment in the same solution, and this provides convenience in facilities as well as in operation.

In order to further improve the properties of the said steel sheet, furthermore, it is recommended for the steel sheet after the said anodic treatment to use a cathodic treating electrolyte containing (a) and (b), below:

a. hexavalent chromium in an amount of approximately 3–40 g./l., as converted into chromic acid; and b. at least one compound selected from the group consisting of an aliphatic and an aromatic monobasic, dibasic and polybasic acid and a salt thereof, in an amount of approximately 5–50 g./l., and to apply cathodic treatment under the approximate conditions including:

| | |
|---|---|
| current density: | 5–30 A/dm² |
| electrolyte temperature: | room temp. (approximately 20°C.)–60°C. |
| electrolysis time: | 1–10 sec. |

This results in a high corrosion resistance and a bright appearance imparted to the said steel sheet surface.

In this invention, the electrolyte for the anodic treatment to be applied to the steel sheet after electrolytic chromate treatment or metallic chromium plating can be of any kind, except for aqueous solution which easily dissolve metallic chromium such as hydrochloric acid and sulfuric acid. Typical electrolytes include an aqueous solution containing one or more of compounds selected from the group consisting of inorganic acids such as boric acid, nitric acid, chromic acid, bichromic acid, phosphoric acid, carbonic acid, titanic acid, vanadic acid and tungstic acid and their salts; hydroxides such as sodium hydroxide and potassium hydroxide; various coordination compounds such as ammine metal complex compounds, metal cyanide complex compounds and metal chelate compounds which are illustrated by hexammine chromium (III) chloride, chloropentammine chromium (III) chloride, chloropentammine cobalt (III) chloride, aquopentammine cobalt (III) chloride, potassium hexacyanochromate (III), potassium hexacyanocobaltate (III) potassium hexacyanoferrate (II), potassium hexacyanoferrate (III), potassium tetracyanocupurate (I), potassium tetracyanoniccolate (II), ethylendiamine tetraacetic acid with chromium ion, cobalt ion, nickel ion or iron ion; and water-soluble organic acids such as aliphatic and aromatic monobasic, dibasic and polybasic acid and their salts. The scope of this selection is very wide. In the said anodic treatmemnt, metallic chromium is naturally dissolved into the solution under the effect of oxidation. Without, however, a serious increase in the amount of deposited hydrated chromium oxides caused by this dissolution, a bright appearance is maintained, and at the same time, the corrosion resistance is considerably improved.

As shown above, any electrolyte except for an aqueous solution easily dissolving metallic chromium is applicable for the anodic treatment. Especially, the use of the same treating solution as that for the cathodic electrolysis applied as the post-treatment permits anodic/cathodic treatment in the same solution.

In the conditions of electrolysis for the said anodic treatment in this invention, any temperature and concentration may be selected without limitation. However, there is a close relation between the quantity of electricity and the thickness of metallic chromium layer. Because the said anodic treatment reactions are principally based on electrochemical dissolution reactions, the quantity of electricity should not be so large as to completely dissolve the metallic chromium layer. However, as a quantity of electricity of less than about 0.2 Coulomb/dm² does not provide improved corrosion resistance, a quantity of electricity of over 0.2 Coulomb/dm² should be applied.

Even in an electrolytically chromate treated steel sheet having a thick hydrated chromium oxide layer tinted with yellow on its exterior, the application of the anodic treatment of this invention can improve the appearance and the corrosion resistance.

As described above, the use of the electrolyte of this invention for the anodic treatment improves the corrosion resistance and the appearance of electrolytically chromate treated or metallic chromium plated steel sheet. The corrosion resistance can further be improved by applying a cathodic treatment:

1. with the said anodically treated steel sheet as the cathode, and with an insoluble conductor such as lead as the anode; and
2. using an electrolyte containing (a) and (b), below:
   a. hexavalent chromium in an amount of approximately 3–40 g./l., as converted into chromic acid; and
   b. at least one compound selected from the group consisting of an aliphatic and an aromatic monobasic, dibasic and polybasic acid and a salt thereof, which does not reduce or hardly reduces hexavalent chromium, such as acetic acid, propionic acid, butyric acid, valeric acid, benzoic acid, succinic acid, adipic acid, trimellitic acid and other organic acids, in an amount of approximately 5–50 g./l.; and
3. under the following approximate electrolysis conditions:

| | | |
|---|---|---|
| (a) | current density: | 5–30 A/dm² |
| (b) | electrolyte temperature: | room temp.(approximately 20°C.)–60°C. |
| (c) | electrolysis time: | 1–10 sec. |

The said electrolyte should contain hexavalent chromium in an amount of approximately 3–40 g./l., as converted into chromic acid, for the following reason. At a content of less than approximately 3 g./l., the electrical resistance of the bath would be too large to supply a current at a current density of higher than 5 A/dm², and this is not practically desirable for an electrolyte. The electrolyte should therefore contain hexavalent chromium in an amount in excess of about 3 g./l. If the electrolyte contains hexavalent chromium in excess of about 40 g./l., the effect on corrosion resistance is not improved further.

The generating mechanism of the effect of addition of the said organic acid(s) is not as yet known, but this addition is considered to form a multinuclear complex with trivalent chromium and thus form a film in transforming into a large molecule structure. The amount of its addition is limited to approximately 5–50 g./l. because the improvement of the corrosion resistance would be, in an addition of less than approximately 5 g./l., less than a half that at an appropriate concentration, i.e., at approximately 5–50 g./l., this not being desirable for a treating solution, and a content in excess of approximately 50 g./l. does not bring about a further increase in corrosion resistance effect.

The electrolysis conditions given above are not the upper limits, but the performances show no remarkable increase even at current density and treating time exceeding these levels. It goes without saying that desired performances cannot be obtained below the lower limits of the said electrolysis conditions.

Salts of the foregoing acids can be ammonium salts and those of a variety of metals, typical of which are: alkali metals such as Na and K and alkali earth metals such as Ca and Ba.

The present invention is explained further with reference to the following illustrative but non-limiting examples, in each of which an aqueous electrolyte solution is employed.

EXAMPLE 1

With a cold rolled steel sheet as the cathode, an electrolytically chromate treated steel sheet was manufactured by applying electrolysis in an electrolyte containing 100 g./l. chromic acid, 5g./l. cryolite and 0.3 g./l. sodium thiocyanate at an electrolyte temperature of 50°C. and a current density of 20 A/dm² for 3 sec., and then dipping the said steel sheet into the same electrolyte for 15 sec. without applying electricity to dissolve hydrated chromium oxides.

EXAMPLE 2

With the electrolytically chromated steel sheet manufactured in Example 1, above, as the cathode, electrolysis was carried out in an electrolyte containing 30 g./l. sodium bichromate and 30 g./l. succinic acid, at an electrolyte temperature of 50°C. and a current density of 20 A/dm² for 2 sec.

EXAMPLE 3

With the electrolytically chromate treated steel sheet manufactured in Example 1, above, as the anode, electrolysis was applied in an electrolyte containing 5 g./l. boric acid at an electrolyte temperature of 25°C. and a current density of 0.5 A/dm² for 2 sec.

EXAMPLE 4

With the electrolytically chromate treated steel sheet manufactured in Example 1, above, as the anode, electrolytic treatment was applied in an electrolyte containing 30 g./l. boric acid at an electrolyte temperature of 25°C. and a current density of 0.5 A/dm² for 2 sec.

EXAMPLE 5

With the electrolytically chromate treated steel sheet manufactured in Example 1, above, as the anode, electrolytic treatment was conducted in an electrolyte containing 40 g./l. sodium bichromate and 50 g./l. adipic acid, at an electrolyte temperature of 25°C. and a current density of 0.5 A/dm² for 2 sec.

Among these Examples 1 to 5, Examples 1 and 2 are out of the scope of the present invention, whereas Examples 3 to 5 are within the scope of the present invention.

EXAMPLE 6

With the electrolytically chromate treated steel sheet manufactured in Example 1, above, as the anode, electrolytic treatment was applied in an electrolyte containing 3 g./l. chromic acid and 15 g./l. adipic acid, at an electrolyte temperature of 50°C. and a current density of 0.5 A/dm² for 2 sec., and then immediately another electrolysis was conducted, with the thus anodically treated steel sheet as the cathode, in the same electrolyte, at a current density of 15 A/dm² for 1 sec.

EXAMPLE 7

With the electrolytically chromate treated steel sheet manufactured in Example 1, above, as the anode, electrolytic treatment was applied in an electrolyte containing 6 g./l. chromic acid and 5 g./l. adipic acid, at an electrolyte temperature of 50°C. and a current density of 1 A/dm² for 1 sec., and then immediately another electrolysis was conducted, with the thus anodically treated steel sheet as the cathode, in the same electrolyte, at a current density of 15 A/dm² for 1 sec.

EXAMPLE 8

With the electrolytically chromate treated steel sheet manufactured in Example 1, above, as the anode, electrolytic treatment was applied in an electrolyte containing 10 g./l. sodium bichromate at an electrolyte temperature of 50°C. and a current density of 0.2 A/dm² for 5 sec., and then immediately another electrolysis was conducted, with the thus anodically treated steel sheet as the cathode, in an electrolyte containing 40 g./l. sodium bichromate and 30 g./l. succinic acid, at an electrolyte temperature of 50°C and a current density of 15 A/dm² for 1 sec.

EXAMPLE 9

With the electrolytically chromate treated steel sheet manufactured in Example 1, above, as the anode, electrolytic treatment was applied in an electrolyte containing 30 g./l. sodium bichromate and 10 g./l. trimellitic acid, at an electrolyte temperature of 50°C. and a current density of 2 A/dm² for 1 sec., and then immediately another electrolysis was conducted, with the thus anodically treated steel sheet as the cathode, in the same electrolyte, at a current density of 15 A/dm² for 1 sec.

EXAMPLE 10

With the electrolytically chromate treated steel sheet manufactured in Example 1, above, as the anode, electrolytic treatment was applied in an electrolyte containing 50 g./l. sodium bichromate and 30 g./l. adipic acid, at an electrolyte temperature of 25°C. and a current density of 0.5 A/dm² for 2 sec., and then immediately another electrolysis was conducted, with the thus anodically treated steel sheet as the cathode, in the same electrolyte, at a current density of 10 A/dm² for 1 sec.

EXAMPLE 11

With the electrolytically chromate treated steel sheet manufactured in Example 1, above, as the anode, electrolytic treatment was applied in an electrolyte containing 40 g./l. sodium bichromate, at an elecytrolyte temperature of 50°C. and a current density of 1 A/dm² for 2 sec., and then immediately another electrolysis was conducted, with the thus anodically treated steel sheet as the cathode, in an electrolyte containing 13 g./l. chromic acid and 30 g./l. succinic acid, at an electrolyte temperature of 50°C. and a current density of 20 A/dm² for 1 sec.

All of these Examples 6 to 11 are within the scope of the present invention.

EXAMPLE 12

With a cold rolled steel sheet as the cathode, an electrolytically chromate treated steel sheet was manufactured by applying electrolysis in an electrolyte containing 50 g./l. chromic acid and 0.3 g./l. sodium thiocyanate at an electrolyte temperature of 45°C. and a current density of 20 A/dm² for 3 sec.

EXAMPLE 13

With the electrolytically chromate treated steel sheet manufactured in Example 12, above, as the anode, electrolytic treatment was applied in an electrolyte containing 10 g./l. sodium bichromate at an electrolyte temperature of 50°C. and a current density of 1 A/dm² for 2 sec.

EXAMPLE 14

With the electrolytically chromate treated steel sheet manufactured in Example 12, above, as the anode, electrolytic treatment was applied in an electrolyte containing 50 g./l. sodium bichromate and 30 g./l. adipic acid at an electrolyte temperature of 25°C. and a current density of 1 A/dm² for 2 sec., and then immediately another electrolysis was carried out, with the thus anodically treated steel sheet as the cathode, in the same electrolyte, at a current density of 10 A/dm² for 1 sec.

EXAMPLE 15

With a cold rolled steel sheet as the cathode, an electrolytically chromate treated steel sheet was manufactured by applying electrolysis in an electrolyte containing 100 g./l. chromic acid, 5 g./l. cryolite and 0.3 g./l. sodium thiocyanate at an electrolyte temperature of 50°C. and a current density of 20 A/dm² for 3 sec.

EXAMPLE 16

A treatment similar to that in Example 13 was applied to the electrolytically chromate treated steel sheet manufactured in Example 15, above.

EXAMPLE 17

A treatment similar to that in Example 14 was applied to the electrolytically chromate treated steel sheet manufactured in Example 15, above.

Among these Examples 12 to 17, Examples 12 and 15 are out of the scope of the present invention, whereas Examples 13, 14, 16 and 17 are within the scope of the present invention.

EXAMPLE 18

With a cold rolled steel sheet as the cathode, a metallic chromium plated steel sheet was manufactured by applying electrolysis in an electrolyte containing 250 g./l. chromic acid and 2.5 g./l. sulfuric acid at an electrolyte temperature of 45°C. and a current density of 20 A/dm² for 5 sec.

EXAMPLE 19

With the metallic chromium plated steel sheet manufactured in Example 18, above, as the anode, electrolytic treatment was applied in an electrolyte containing 20 g./l. chromic acid and 5 g./l. adipic acid, at an electrolyte temperature of 50°C. and a current density of 1 A/dm² for 1 sec., and then immedjiately another electrolysis was conducted, with thus anodically treated steel sheet as the cathode, in the same electrolyte, at a current density of 15 A/dm² for 1 sec.

Among these Examples 18 and 19, Example 18 is out of the scope of the present invention, whereas Example 19 is within the scope of the present invention.

For all the electrolytically chromate treated or metallic chromium plated steel sheets and electrolytically post-treated electrolytically chromate treated or metallic chromium plated steel sheets manufactured in Examples 1 to 19, presented above, a 120-hr. humidity cabinet test (JIS-Z-0228) was applied, and at the same time, the amount of hydrated chromium oxides on the said steel sheet surfaces was measured.

The results of the said test and measurement are given in the following table:

| Example No. | 120-hr. humidity cabinet test*(%) | Amount of hydrated chromium oxides (mg/dm²) | Appearance |
|---|---|---|---|
| 1 | 5 | 0.03 – 0.04 | Good |
| 2 | 44 | 0.05 – 0.06 | " |
| 3 | 63 | 0.06 – 0.07 | " |
| 4 | 58 | 0.05 – 0.06 | " |
| 5 | 66 | 0.06 – 0.07 | " |
| 6 | 76 | 0.05 – 0.06 | " |
| 7 | 75 | 0.05 – 0.06 | " |
| 8 | 87 | 0.05 – 0.07 | " |
| 9 | 85 | 0.05 – 0.06 | " |
| 10 | 88 | 0.06 – 0.07 | " |
| 11 | 93 | 0.06 – 0.07 | " |
| 12 | 32 | ca. 0.4 | Poor |
| 13 | 60 | 0.05 – 0.07 | Good |
| 14 | 84 | 0.07 – 0.08 | " |
| 15 | 34 | 0.2 – 0.3 | Poor |
| 16 | 57 | 0.05 – 0.07 | Good |
| 17 | 76 | 0.06 – 0.08 | " |
| 18 | 10 | trace | " |
| 19 | 61 | 0.03 – 0.04 | " |

*Marks in the 120-hr. humidity cabinet test given in the table represent percentages obtained by dividing a test piece (6 × 8 cm.) into 400 checkers and counting those not showing rust generation.

As is clear from the table given above, the humidity cabinet test results for the steel sheets subjected to only electrolytic chromate treatment in Examples 1, 12, 15 and 18, out of the scope of the present invention, show low values of 34 percent or less. Especially in Examples 12 and 15, the large amount of hydrated chromium oxides resulted in an unsatisfactory exterior view and a low corrosion resistance. Example 2, also out of the scope of this invention, reveals that the cathodically treated electrolytically chromated steel sheet without anodic treatment gave a humidity cabinet test result of only 44 percent, which indicates unsatisfactory corrosion resistance. In the other examples within the scope of the present invention, in contrast, the humidity cabinet test results are as high as 57 percent and above, in spite of the slightest amount of hydrated chromium oxide in all cases, and this directly indicates a remarkably improved corrosion resistance and a bright appearance.

This invention, as shown above, is advantageous in providing electrolytic post-treated steel sheets having a bright appearance and a high corrosion resistance through the anodic treatment of electrolytically chromate treated or metallic chromium plated steel sheets, and, if necessary, by the application of an additional cathodic treatment.

What we claim is:

1. A method for electrolytically post-treating the surface of an electrolytically chromate treated or metallic chromium plated steel sheet, which comprises anodically treating said sheet, said sheet being employed as an anode, with a quantity of electricity of from at least about 0.2 Coulomb/dm$^2$ to a quantity insufficient to completely dissolve the metallic chromium layer, and in an electrolyte comprising an aqueous solution containing (a) and (b), below:

a. from about 3 to about 40 grams per liter of hexavalent chromium, expressed as chromic acid, and b. from about 5 to about 50 grams per liter of at least one compound selected from the group consisting of an aliphatic and aromatic monobasic, dibasic and polybasic acid and a salt thereof.

2. The method of claim 1, wherein said anodically treated steel sheet is subsequently treated cathodically, said anodically treated steel sheet being employed as a cathode, with a current density of from about 5 to about 30 A/dm$^2$, at an electrolyte temperature of from about 20°C. to about 60°C., for an electrolysis time of from about 1 to about 10 seconds, and in the same electrolyte as that for said anodic treatment.

3. The method of claim 1, wherein the steel sheet is an electrolytically chromate treated sheet.

4. The method of claim 1, wherein the steel sheet is a metallic chromium plated sheet.

5. The method of claim 2, wherein the steel sheet is an electrolytically chromate treated sheet.

6. The method of claim 2, wherein the steel sheet is a metallic chromium plated sheet.

* * * * *